US011400573B2

(12) United States Patent
Tan et al.

(10) Patent No.: US 11,400,573 B2
(45) Date of Patent: Aug. 2, 2022

(54) PNEUMATIC TOOL

(71) Applicant: TTI (MACAO COMMERCIAL OFFSHORE) LIMITED, Macau (MO)

(72) Inventors: Ying Xiang Tan, Dongguan (CN); Jin Lin Zhou, Dongguan (CN); Hai Ling Lin, Dongguan (CN)

(73) Assignee: Techtronic Power Tools Technology Limited, Tortola (VG)

( * ) Notice: Subject to any disclaimer, the term of this patent is extended or adjusted under 35 U.S.C. 154(b) by 238 days.

(21) Appl. No.: 16/521,743

(22) Filed: Jul. 25, 2019

(65) Prior Publication Data

US 2020/0030953 A1 Jan. 30, 2020

(30) Foreign Application Priority Data

Jul. 26, 2018 (CN) ..... 201810834474.4

(51) Int. Cl.
*B25C 1/00* (2006.01)
*B25C 1/04* (2006.01)

(52) U.S. Cl.
CPC ..... *B25C 1/008* (2013.01); *B25C 1/047* (2013.01)

(58) Field of Classification Search
CPC ..... B25C 1/008; B25C 1/047; B25C 1/04; B25C 1/06; B25C 7/00
USPC ..... 172/90; 227/107–155
See application file for complete search history.

(56) References Cited

U.S. PATENT DOCUMENTS 4,129,240 A * 12/1978 Geist ..... B25C 1/06 227/131
4,928,868 A * 5/1990 Kerrigan ..... B25C 1/06 227/131
5,069,379 A * 12/1991 Kerrigan ..... B25C 1/06 227/131
5,720,423 A * 2/1998 Kondo ..... B25C 1/04 227/130

(Continued)

FOREIGN PATENT DOCUMENTS

CN 204736190 U 11/2015
CN 107206580 A 9/2017

(Continued)

OTHER PUBLICATIONS

European Patent Office Extended Search Report for Application No. 19185854.7 dated Nov. 25, 2019 (7 pages).

(Continued)

*Primary Examiner* — Robert F Long
(74) *Attorney, Agent, or Firm* — Michael Best & Friedrich LLP

(57) ABSTRACT

A pneumatic tool is provided comprising: a motor; a drive mechanism connected to the motor; a cylinder; the drive mechanism comprising a drive bar connected to a piston, the drive bar adapted to drive the piston in a linear direction; the cylinder filled with high pressure gas; wherein the piston is housed in the cylinder and adapted to reciprocate within the cylinder; the piston is connected to a striking member adapted to strike a workpiece; wherein the drive mechanism further comprises a plurality of latching members adapted to be in contact with and lock the drive bar. The latching structure provided by the present invention has a smaller sliding distance and is safer than conventional drive bar latching structures.

20 Claims, 5 Drawing Sheets

(56) References Cited

U.S. PATENT DOCUMENTS 5,881,940 A * 3/1999 Almeras ..... B25C 1/14 227/10
5,934,162 A * 8/1999 Habermehl ..... F16B 27/00 81/434
5,937,683 A * 8/1999 Chartier ..... B21D 1/12 72/21.5
5,947,362 A * 9/1999 Omli ..... B25C 5/1693 227/120
5,996,874 A * 12/1999 Fukushima ..... B25B 21/023 173/104
6,123,243 A * 9/2000 Pfister ..... B25C 1/14 227/10
6,357,534 B1 3/2002 Buetow et al.
6,647,836 B1 * 11/2003 Habermehl ..... B25B 23/045 173/107
6,708,860 B1 * 3/2004 Thieleke ..... B25C 1/184 227/119
6,845,693 B1 * 1/2005 Babij, Jr. ..... B25B 23/04 81/434
7,410,084 B1 * 8/2008 Reed ..... B25C 1/00 227/119
10,654,155 B2 * 5/2020 Meyer ..... B25C 1/008
10,898,994 B2 * 1/2021 Carrier ..... B25C 1/047
2002/0053587 A1 * 5/2002 White ..... B25C 1/06 227/131
2005/0001007 A1 * 1/2005 Butzen ..... B25C 1/047 227/130
2005/0126345 A1 * 6/2005 Berthiaume ..... B25C 9/00 81/44
2006/0180631 A1 * 8/2006 Pedicini ..... B25C 1/06 227/130
2007/0210134 A1 * 9/2007 Oda ..... B25C 1/06 227/131
2007/0215665 A1 * 9/2007 Ohmori ..... B25C 7/00 227/8
2007/0290019 A1 * 12/2007 Tille ..... B25C 1/005 227/10
2008/0179372 A1 * 7/2008 Kurth ..... B25C 1/184 227/136
2009/0090759 A1 * 4/2009 Leimbach ..... B25C 1/047 227/10
2009/0095787 A1 * 4/2009 Liang ..... B25C 1/06 227/131
2009/0194573 A1 * 8/2009 Liang ..... B25C 1/06 227/131
2009/0250500 A1 * 10/2009 Brendel ..... B25C 1/06 227/132
2009/0289094 A1 * 11/2009 Schiestl ..... B25C 1/008 227/8
2010/0213233 A1 * 8/2010 Liu ..... B25C 1/001 227/120
2011/0062207 A1 * 3/2011 Hlinka ..... B25C 1/008 227/8
2011/0108299 A1 * 5/2011 Wei ..... B25D 17/00 173/122
2011/0132959 A1 * 6/2011 Hlinka ..... B25C 1/008 227/8
2011/0198381 A1 * 8/2011 McCardle ..... B25C 1/06 227/8
2011/0259938 A1 * 10/2011 Chien ..... B25F 5/006 227/129
2015/0096776 A1 * 4/2015 Garber ..... B25C 1/008 173/1
2016/0096259 A1 * 4/2016 Pedicini ..... B25C 1/047 227/146
2016/0229043 A1 * 8/2016 Wyler ..... B25C 1/06
2016/0288305 A1 10/2016 McCardle et al.
2016/0333542 A1 * 11/2016 Jinnings ..... E02D 7/10
2017/0066116 A1 * 3/2017 Garber ..... B25C 1/06
2017/0239800 A1 * 8/2017 Moore ..... B25C 1/047
2018/0126227 A1 5/2018 Bava
2018/0126527 A1 5/2018 Pomeroy et al.
2018/0126528 A1 * 5/2018 Pomeroy ..... B25C 1/06
2018/0154505 A1 * 6/2018 Sato ..... B25C 1/06
2018/0290279 A1 * 10/2018 Kobori ..... B25C 1/06
2019/0168366 A1 * 6/2019 Yasutomi ..... B25C 1/047
2019/0366527 A1 * 12/2019 Akiba ..... B25C 5/15
2019/0375084 A1 * 12/2019 Bierdeman ..... B25C 1/06
2020/0030953 A1 * 1/2020 Tan ..... B25C 1/047
2020/0114500 A1 * 4/2020 Bierdeman ..... B25C 1/06
2020/0189080 A1 * 6/2020 Aizawa ..... B25C 1/06
2021/0008701 A1 * 1/2021 Tan ..... B25C 1/06
2021/0138623 A1 * 5/2021 Bierdeman ..... B25C 1/04

FOREIGN PATENT DOCUMENTS

CN 107471156 A 12/2017
EP 3315260 A1 5/2018

OTHER PUBLICATIONS

Chinese Patent Office Action for Application No. 201810834474.4 dated Jan. 24, 2022 (8 pages including statement of relevance).

* cited by examiner

PNEUMATIC TOOL

FIELD OF THE DISCLOSURE

This invention relates to power tools, and more particularly to power tools that use compressed air as a power source to drive a workpiece.

BACKGROUND

Pneumatic tools such as nail guns and the like generally use high-pressure gas as a power source to drive a workpiece such as a nail or the like to be ejected at a high speed. In general, in each cycle in which the workpiece is ejected, it is necessary to firstly compress the high-pressure gas in a cylinder to a certain extent, so that the piston is in place, and then the piston is released at the moment to be ejected, thereby generating powerful kinetic energy to complete the striking operation. Such a cylinder-piston configuration is commonly referred to as a "gas spring." One kind of gas spring arrangement, for example, uses an intermeshing drive bar and a drive gear, where the drive gear is rotated to convert the rotational force of the motor in the pneumatic tool into a linear motion of the drive bar, thereby pushing the piston to compress of the high pressure gas. In addition to gas springs, mechanical springs can also be used as energy storage mechanisms for the pneumatic tool.

However, the pneumatic tool is prone to nail blocking during use. In order to remove the stuck nails in the pneumatic tool and to ensure the safety of the user, the drive bar must be locked when the pinching occurs, so that the drive bar does not suddenly move in the direction of the strike during removing the pinching. A latching member is commonly used in pneumatic tools to lock the drive bar with latching teeth that engage the rows of teeth on the drive bar. However, due to a pitch of the rows of teeth on the drive bar and the size of a gap, even if the drive bar is locked, it is still possible for the drive bar to have a short distance of rapid displacement before being locked, so it is still possible to cause damages to users to a certain extent.

SUMMARY

Accordingly, embodiments of the present invention provide a different pneumatic tool that at least mitigates the above technical problem.

In one aspect of the invention, a pneumatic tool is provided which contains a motor, a drive mechanism connected to the motor and a cylinder. The drive mechanism contains a drive bar connected to a piston, and the drive bar is adapted to drive the piston in a linear direction. The cylinder is filled with high pressure gas. The piston is housed in the cylinder and is adapted to reciprocate within the cylinder. The piston is connected to a striking member adapted to strike a workpiece. The drive mechanism further contains a plurality of latching members adapted to be in contact with and lock the drive bar.

Preferably, the plurality of latching members is configured to move independently of one another.

Additionally or alternatively, the plurality of latching members is configured to be staggered relative to each other along a longitudinal direction of the drive bar.

In a variation of the preferred embodiment, each of the plurality of latching members is connected to a separate resilient member.

In another variation, the plurality of latching members is symmetrically disposed on both sides of a central axis of the drive bar.

In still another variation, the drive bar is formed with a plurality of rows of teeth arranged in parallel. The plurality of latching members is adapted to respectively engage one of the plurality of rows of teeth.

In one implementation, the drive structure further contains an actuator adapted to be manually operated by a user. The actuator is connected to the plurality of latching members to cause each of the plurality of latching members to be adapted to move from the released position to the locked position.

In another implementation, the drive structure further contains an electronic device connected to the plurality of latching members. The electronic device is adapted to lock the plurality of latching members to prevent the latter from moving.

Preferably, the electronic device is a solenoid.

More preferably, the electronic device is connected to the plurality of latching members by a locking device.

More preferably, each of the plurality of latching members is adapted to move between a released position and a locked position. The locking member contains a locking member adapted to be locked by the electronic device. The locking member is adapted to move in a direction different from a direction of movement of the plurality of latching members to lock or unlock the plurality of latching members.

Most preferably, the direction of movement of the plurality of latching members is the same. The locking member is adapted to move in a direction perpendicular to the direction of movement of the plurality of latching members to lock or unlock the plurality of latching members.

Embodiments of the present invention thus provide a novel drive bar locking mechanism that is superior to those of conventional pneumatic tools. Since there are two or more latching members present at the same time, the latching members can engage and lock the drive bars at different times and/or locations. Therefore, the locking of the driving bar in the present invention does not need to wait for the sliding distance of the entire teeth pitch, but only a smaller sliding distance, and therefore the invention provides a safer way to lock the drive bar for cleaning blocking nails and the like.

BRIEF DESCRIPTION OF THE DRAWINGS

The performance and advantages of the present invention will be further understood by reference to the remainder of the specification and the accompanying drawings. The same components in these figures have the same label.

DETAILED DESCRIPTION OF PREFERRED EMBODIMENTS

Figure 1A:
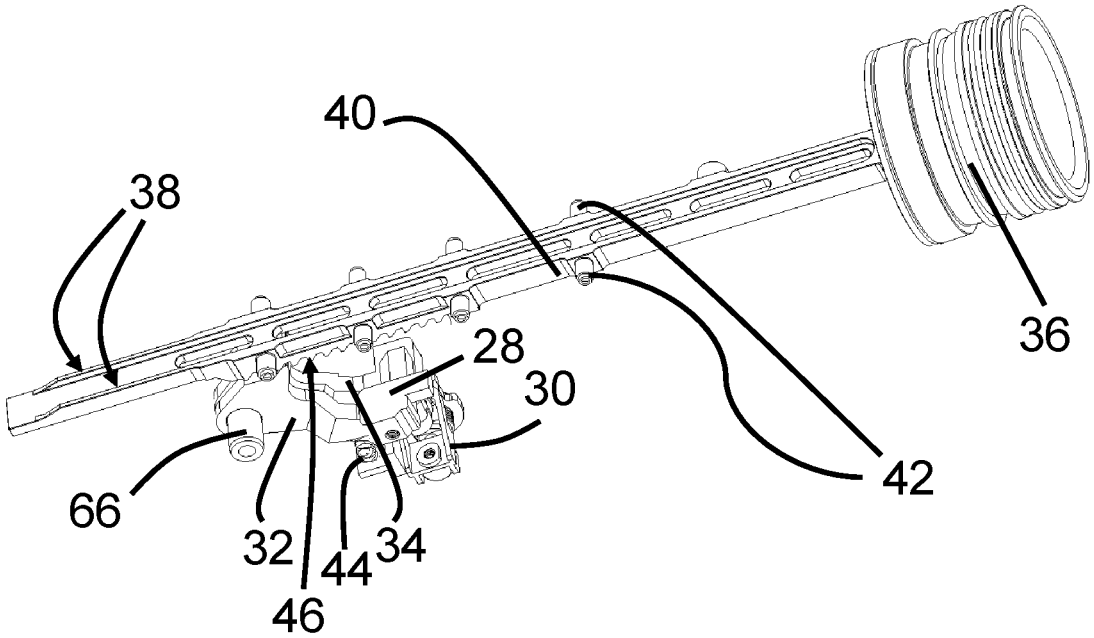
FIGS. 1*a* and 1*b* respectively show perspective views of an internal structure of a pneumatic tool in accordance with an embodiment of the present invention from different angles.

Embodiments of the present invention use more than one latching member to achieve a shorter sliding distance required when the drive bar is locked. Other different benefits and advantages provided by embodiments of the present invention are readily apparent from the following description.

Referring to FIGS. 1*a*-1*b*, 2 and 4, in a first embodiment of the invention, a pneumatic tool, in particular a nail gun, is disclosed. The nail gun includes a housing, handle, etc. as being well known to a person skilled in the art, but which are not shown here for the sake of brevity. In contrast, FIG. 4 directly shows a cylinder 58, a piston 36 received in the cylinder 40 and reciprocable, and a drive bar 40 with one end connected to the piston 36 and moving together with the piston 36. The drive bar 40 has an elongated shape, and the other end, opposite to the end on which the piston 36 is provided, is provided with a striking member (not shown) which can directly strike a workpiece (e.g., a nail) to achieve the working effect of the nail gun. The drive bar 40 is adapted to be driven by a motor of a pneumatic tool through a drive mechanism (neither shown). In particular, the drive mechanism can include drive wheels (not shown) with teeth that can engage the projections 42 on the drive bar 40 to cause the drive bar 40 and the piston 36 to move in a linear manner, so as to compress high pressure gas in the cylinder 58, that is, to store energy.

Figure 1B:
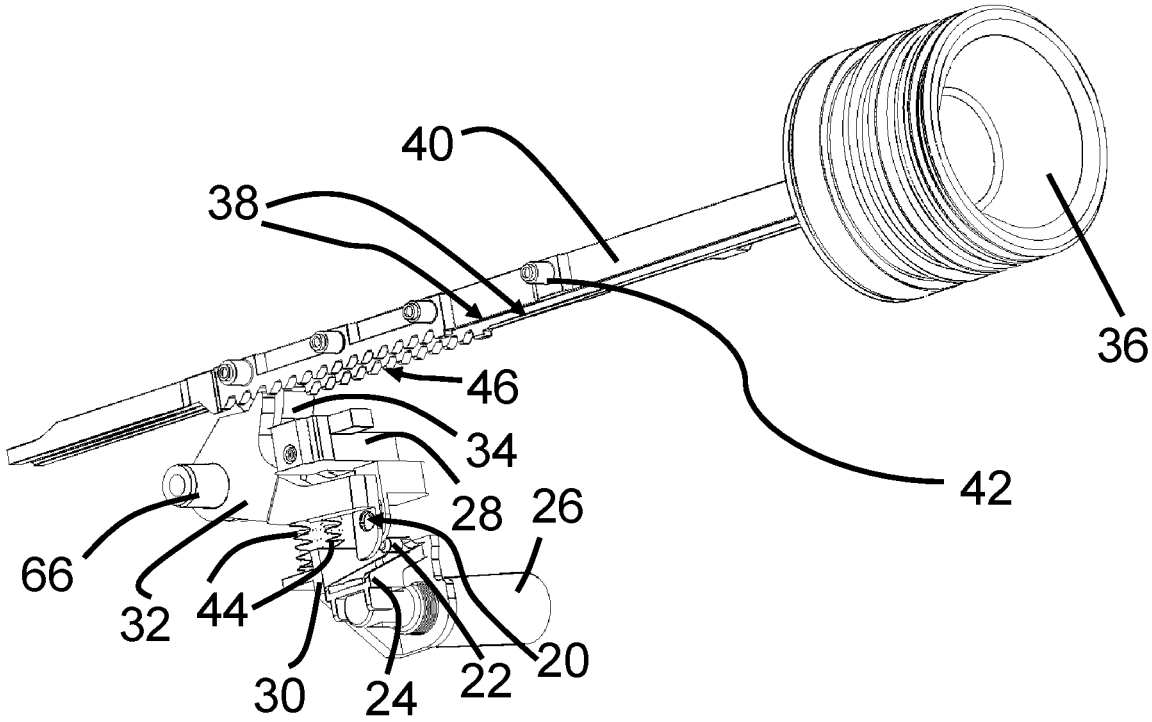
Figure 2:
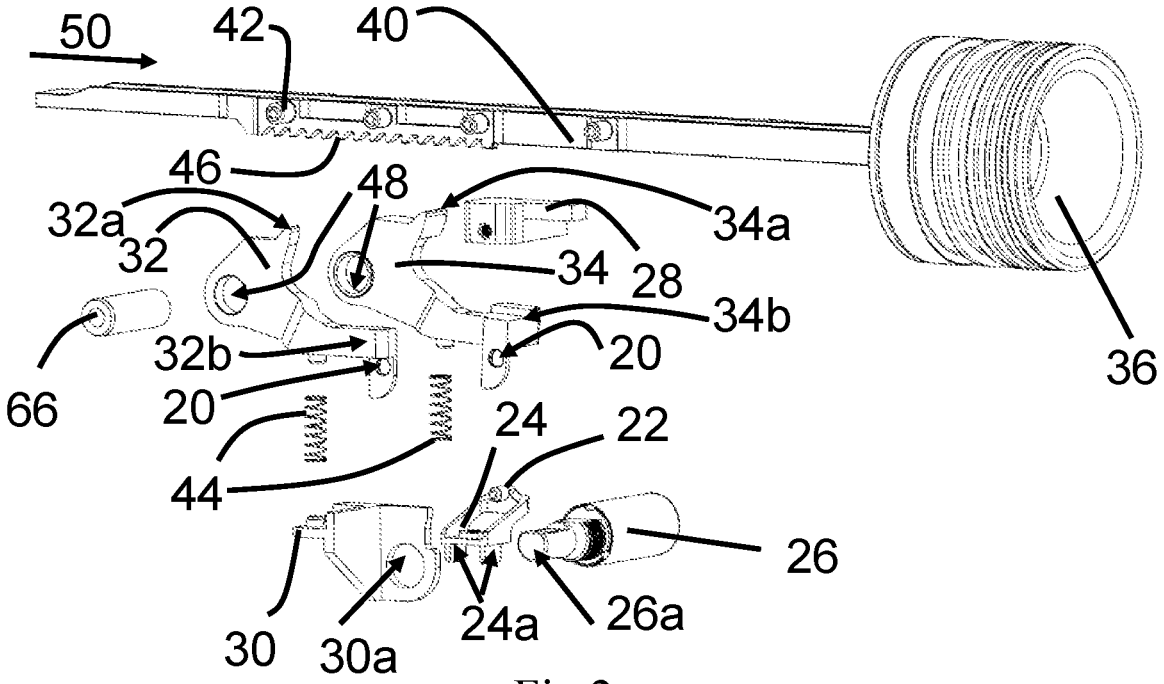
FIG. 2 is an exploded view of the components of the internal structure of the pneumatic tool of FIG. 1.
Figure 3:
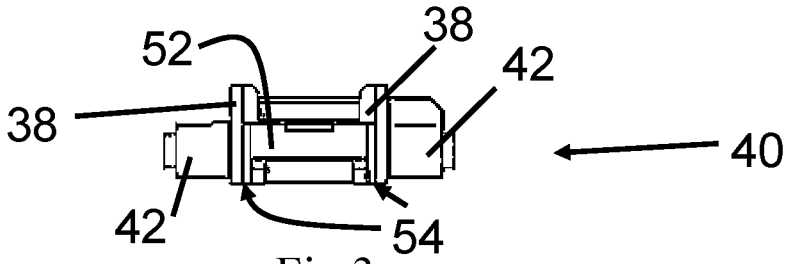
FIG. 3 is a side view of a drive bar of the pneumatic tool of FIG. 1 as seen in the direction of reference numeral 50.
Figure 4:
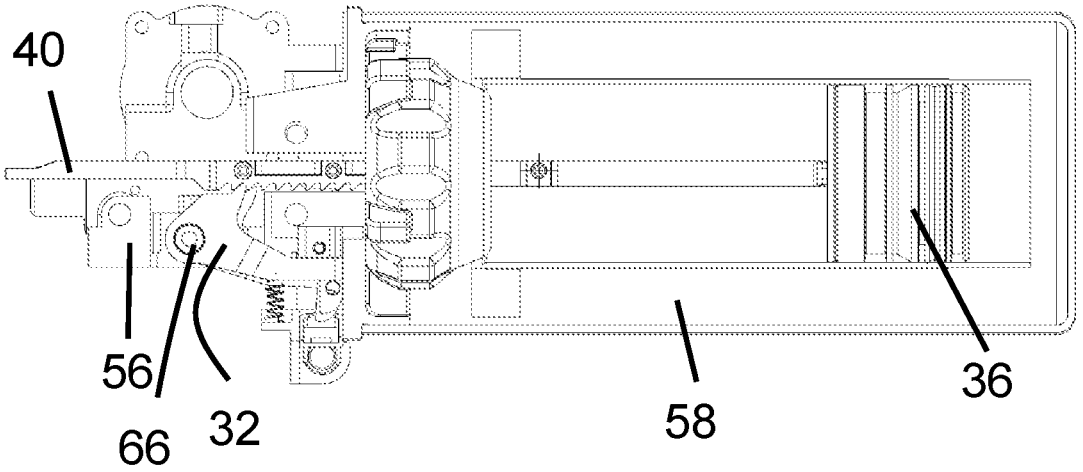
FIG. 4 is a view showing the appearance of the internal structure of the pneumatic tool of FIG. 1 in combination with a frame and the cylinder.

The shape and the structure of the drive bar 40 are most clearly seen in FIGS. 1*a*-1*b* and FIG. 3. The drive bar 40 includes an intermediate body 52 and side portions 38 that are formed on both sides of the intermediate body 52 and that are integrally formed with the intermediate body 52. Each of the side portions 38 extends in a direction perpendicular to the intermediate body 52. On the opposite outer sides of the two side portions 38, the above-described projections 42 are formed. At the lower end 54 of each side portion 38, a row of teeth 46 is formed in which there are consecutively aligned teeth 46*a*. Please note that a row of teeth 46 is not shown in FIG. 3, because the row of teeth on the drive bar 40 is not directly visible when viewed from the direction 50 in FIG. 2.

Below the drive bar 40, there is a first latching member 32 and a second latching member 34. The first latching member 32 and the second latching member 34 are substantially identical in shape and are simultaneously rotatably secured to a pivot 66 positioned in an aperture 48 of the first latching member 32 and the second latch member 34. It can be seen from FIG. 2 that a head end 32*a* of the first latching member 32 is thinner than the head end 34*a* of the second latching member 34, while a trailing end 32*a* of the first latching member 32 is also thinner than a trailing end 34*b* of the second latching member 34. On the trailing end 32*b* of the first latching member 32 and trailing end 34*b* of the second latching member 34, locking holes 20 are formed for engaging the locking bolts 22 of the locking member 24 to effect the locking of the movement of the first latching member 32 and the second latching member 34. The first latching member 32 and the second latching member 34 are also each connected to one end of a spring 44, and the other ends of the two springs 44 are fixed to a spring seat 30. A through hole 30*a* is formed in the spring seat 30 for allowing a plunger 26*a* of a solenoid 26 to pass therethrough. Note that the spring seat 30 does not move with the plunger 26*a* but is fixed to a frame 56 of FIG. 4. In addition, a pressing member 28 is configured on the trailing end 32*b* of the first latching member 32 and the trailing end 34*b* of the second latching member 34, and the first latching member 32 and the second latch can be caused to move together by the movement of the pressing member 28.

Figure 5A:
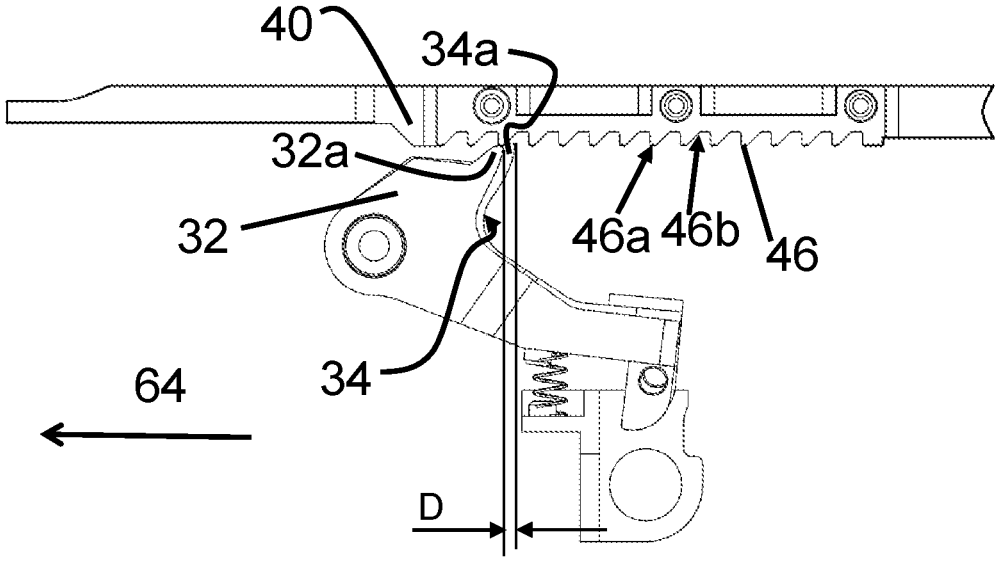
FIGS. 5*a* and 5*b* respectively show front views of the state in which the drive bar is about to be locked by the latching member and the drive bar has been locked in the internal structure of the pneumatic tool of FIG. 1.
Figure 5B:
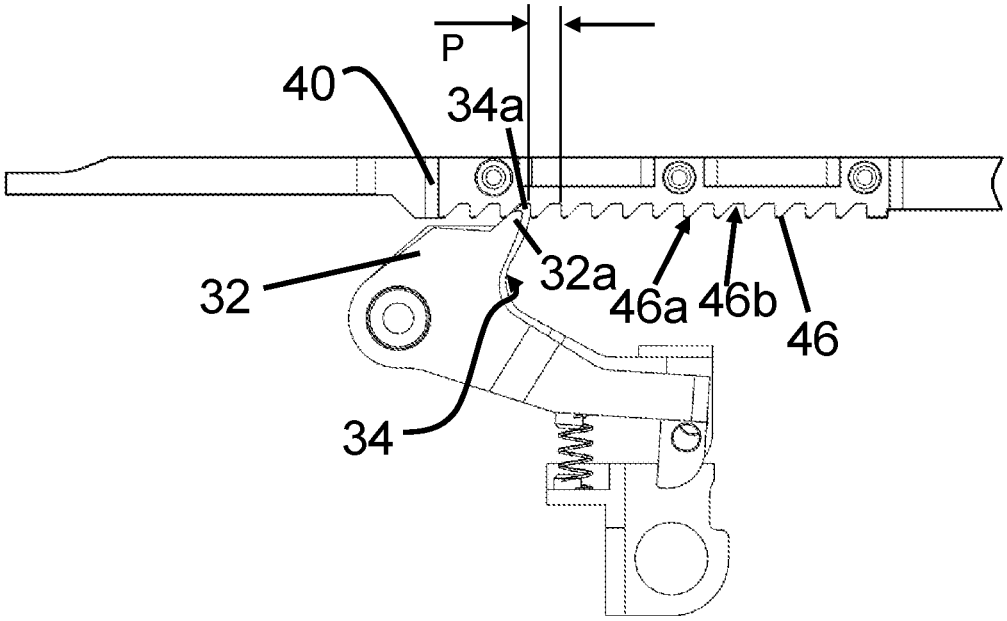

The first latching member 32 and the second latching member 34 are placed in a generally parallel manner, as best seen in FIGS. 1*a*-1*b* and FIG. 2. However, it can be noted that the head end 32*a* of the first latching member 32 and the head end 34*a* of the second latching member 34 are not completely parallel in the position in which the drive bar 40 is contacted. In contrast, as shown in FIGS. 5*a*-5*b*, the head end 34*a* of the second latching member 34 is offset in the lengthwise direction of the drive bar 40 relative to the head end 32*a* of the first latching member 32. In particular, the head end 34*a* of the second latching member 34 is closer to the piston 36 than the head end 32*a* of the first latching member 32. The distance between the head end 34*a* of the second latching member 34 relative to the head end 32*a* of the first latching member 32 is indicated by D, which is shown in FIG. 5*a*, while at the same time the distance between two adjacent teeth 46*a* on the row of teeth 46 on the drive bar 40 is denoted by P, that is, the pitch. P is equal to the length of the recess 46*b* formed between two adjacent teeth 46*a*. In a specific embodiment, P is about 4 mm and D is about 2 mm.

The lower portion of the locking member 24 described above has an arch shape including two lower ends 24*a*. The two lower ends 24*a* define a gap between them, such that the plunger 26*a* of the solenoid 26 passes through the gap, so that the locking member 24 rides on the plunger 26*a* and moves with it. The lower portion of the locking member 24 has a locking bolt 22 as described above that is movable together with the movement of the plunger 26*a* caused by the action of the solenoid 26, such as entering or exiting the locking holes formed in the trailing end 32*b* of the first latching member 32 and the trailing end 34*b* of the second latching member 34, respectively.

Figure 6A:
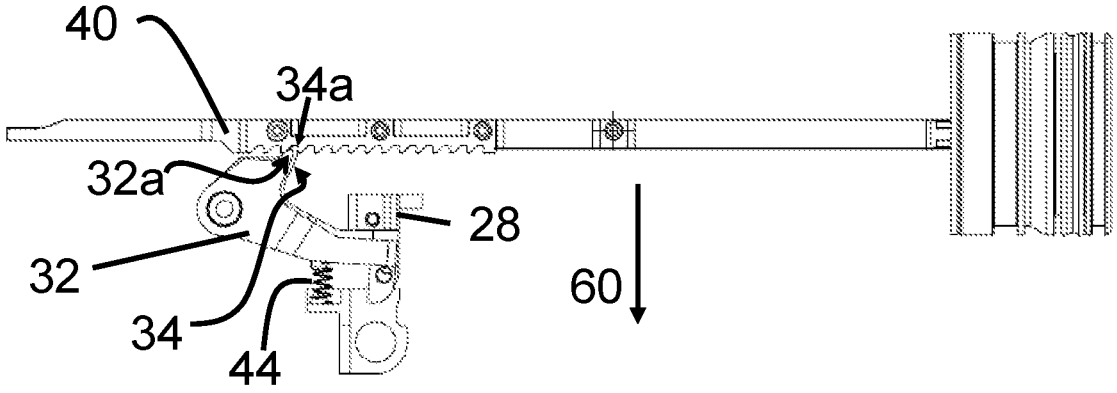
FIGS. 6*a* and 6*b* respectively show front views of the state in which the drive bar is locked by the latching member and the latching member is disengaged from the drive bar to make the drive bar released in the internal structure of the pneumatic tool of FIG. 1.
Figure 6B:
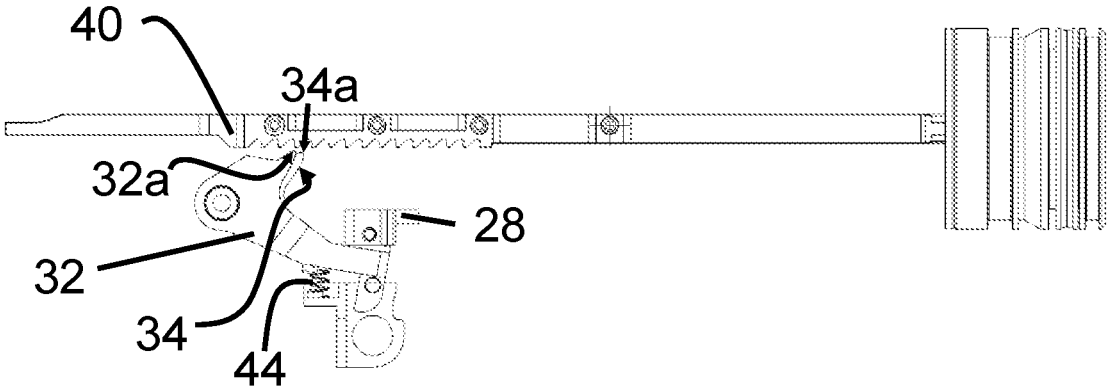
Figure 7B:
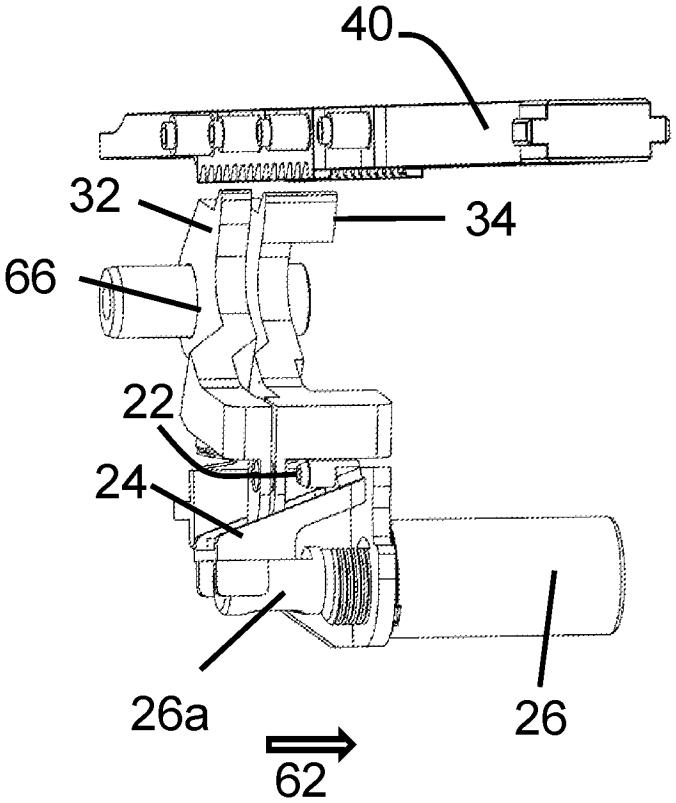
FIGS. 7*a* and 7*b* respectively show perspective views of the state in which the latching member is locked by the locking structure and the latching member is unlocked in the internal structure of the pneumatic tool of FIG. 1.
Figure 7A:
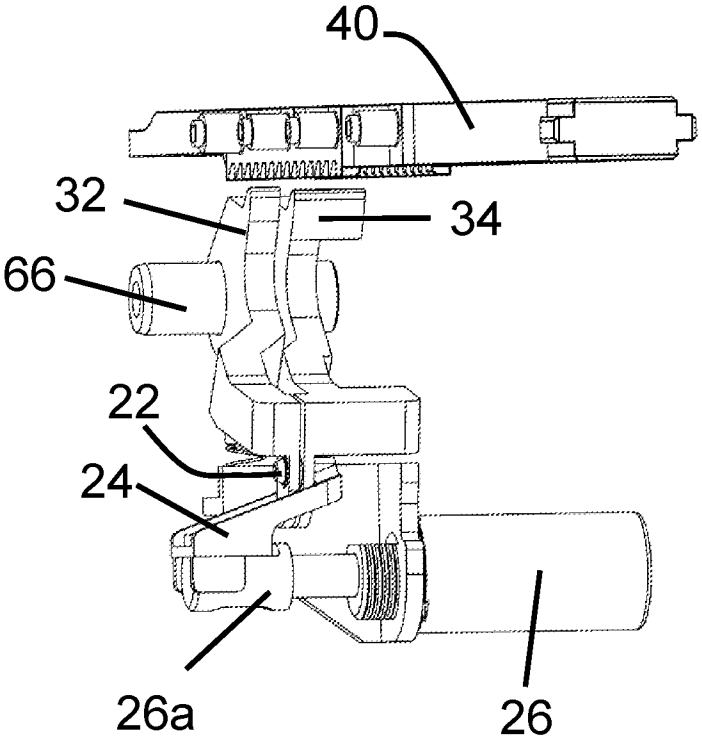

Turning now to the operation principle of the drive bar locking mechanism of the nail gun in the above embodiment. When the nail gun is operating normally, the first latching member 32 and the second latching member 34 are not in contact with the drive bar 40, as in the state shown in FIG. 6*b*. At this time, the state and relative position of the solenoid 26, the locking member 24, and the first latching member 32 and the second latching member 34 are as shown in FIG. 7*a*. In this state, the first latching member 32 and the second latching member 34 are in the locked position, because they are locked by the locking member 24. The locking member 24 passes through, via the locking bolt 22, the locking hole 20 formed on the trailing end 32*b* of the first latching member 32 and on the trailing end 34*b* of the second latching member 34, respectively, to lock the first latching member 32 and the second latching member 34. At this time, the plunger 26*a* of the solenoid 26 is in the extended position. By locking the first latching member 32 and the second latching member 34 in their locked positions, the first latching member 32 and the second latching member 34 are not in contact with the drive bar 40 during normal operation of the pneumatic tool, to avoid unnecessary mechanical wear.

When a nail blocking occurs in the pneumatic tool, a control circuit (not shown) of the pneumatic tool will control the motor to stop operating. At the same time, the control circuit controls the solenoid 26 to actuate, i.e., the plunger 26*a* is retracted back to its retracted position in the direction 62, which is shown in FIG. 7*b*. With the movement of the plunger 26*a*, the locking bolt 22 of the locking member 24 is separated from the locking hole 20 formed on the trailing end 32*b* of the first latching member 32 and the trailing end 34*b* of the second latching member 34, thereby releasing the locking of the first latching member 32 and the second latching member 34. It is to be noted that the moving direction 62 of the plunger 26*a* and the moving/rotating direction of the first latching member 32 and the second latching member 34 are exactly perpendicular.

When the first latching member 32 and the second latching member 34 are no longer locked, they will immediately move toward the release position, which is caused by the spring 44 applying a restoring force to the first latching member 32 and the second latching member 34. Each one of the first latching member 32 and the second latching member 34 has a separate spring 44, so that the first latching member 32 and the second latching member 34 can move independently relative to each other, so that they will not be interfered with each other when they lock the drive bar 40.

Since the head end 34*a* of the second latching member 34 described above is placed at a distance D from the head end 32*a* of the first latching member 32, when the first latching member 32 and the second latching member 34 move to the released position, either one of the first latching member 32 and the second latching member 34 is engaged in the drive bar 40 in advance anyway. For example, in the state shown in FIG. 5*a*, both the head end 34*a* of the second latching member 34 and the head end 32*a* of the first latching member 32 are about to be in contact with the drive bar 40, but at this time the head end 32*a* of the first latching member 32 is just in contact with a tooth 46*a*, so the drive bar 40 cannot be locked unless the drive bar 40 continues to move to be locked. However, at this time, the head end 34*a* of the second latching member 34 does not face any of the teeth 46*a*, so the drive bar 40 only needs to slightly move (in the direction 64 in FIG. 5*a*) to enable that the head end 34*a* of the second latching member 34 is just aligned with a recess 46*b* formed between two adjacent teeth 46*a* and enters the recess 46*b* for locking of the drive bar 40. Therefore, in this embodiment the drive bar 40 needs to slide for a smaller distance than the case when there is only one latching member. Specifically, in the present embodiment, the maximum distance that the drive bar 40 will slide is D, that is, 2 mm, before cleaning the blocking nail.

After the cleaning of the blocking nail is completed, the user needs to reset the pneumatic tools to resume their normal use. Specifically, after the cleaning is completed (in the state shown in FIG. 6*a*), the user needs to press the above-mentioned pressing member 28. This causes the pressing member 28 to move downward in the direction of the arrow 60 in FIG. 6*a* and to move the first latching member 32 and the second latching member 34 downward at the same time. This requires overcoming the elastic force of the spring 44. Thereby, the first latching member 32 and the second latching member 34 return to the locked position in FIG. 6*b* from their released position. At the same time, the locking member 24 and the solenoid 26 will be reset to the projecting position and lock the first latching member 32 and the second latching member 34.

Having thus described the embodiments of the invention, a person skilled in the art will recognize that various modifications, additional structures, and equivalents may be used without departing from the spirit of the invention. Accordingly, the above description should not be taken as a limitation to the scope of the invention as defined by the following claims.

What is claimed is:

1. A pneumatic tool, comprising:

a motor;

a drive mechanism connected to the motor, the drive mechanism comprising a drive bar connected to a piston, the drive mechanism having a drive wheel configured to engage projections on the drive bar adapted to drive the piston in a linear direction;

a cylinder filled with high pressure gas;

wherein the piston is housed in the cylinder and adapted to reciprocate within the cylinder, the piston connected to a striking member adapted to strike a workpiece;

wherein the pneumatic tool further comprises a plurality of latching members adapted to be in contact with and lock the drive bar, wherein each of the plurality of latching members are configured to move independently of one another between a locked position that is configured to stop the plurality of latching members from engaging the drive bar and a released position that is configured to allow the plurality of latching members to engage and lock the drive bar.

2. The pneumatic tool of claim 1, wherein the plurality of latching members are configured to be staggered relative to each other along a longitudinal direction of the drive bar.

3. The pneumatic tool of claim 1, wherein each of the plurality of latching members is connected to a separate resilient member.

4. The pneumatic tool of claim 1, wherein the plurality of latching members is symmetrically disposed on both sides of a central axis of the drive bar.

5. The pneumatic tool of claim 1, wherein the drive bar includes a pair of side portions defining a lower edge; wherein the drive bar is formed with a plurality of rows of teeth arranged in parallel at the lower edge; wherein the plurality of latching members are adapted to respectively engage one of the plurality of rows of teeth.

6. The pneumatic tool of claim 1, wherein the drive mechanism further comprises an actuator adapted to be manually operated by a user, the actuator is connected to the plurality of latching members to cause each of the plurality of latching members to be adapted to move from a released position to a locked position.

7. The pneumatic tool of claim 1, wherein the drive mechanism further comprises an electronic device connected to the plurality of latching members; the electronic device is adapted to lock the plurality of latching members to prevent the latter from moving.

8. The pneumatic tool of claim 7, wherein the electronic device is a solenoid.

9. The pneumatic tool of claim 7, wherein the electronic device is connected to the plurality of latching members by a locking device.

10. The pneumatic tool of claim 9, wherein a locking member is adapted to be locked by the electronic device; the locking member is adapted to move in a direction different from a direction of movement of the plurality of latching members to lock or unlock the plurality of latching members.

11. The pneumatic tool of claim 10, wherein the direction of movement of the plurality of latching members are the same; the locking member is adapted to move in a direction perpendicular to the direction of movement of the plurality of latching members to lock or unlock the plurality of latching members.

12. A pneumatic tool, comprising:

a motor;

a cylinder filled with high pressure gas;

a drive bar connected to a piston housed in the cylinder and adapted to reciprocate within the cylinder, the piston connected to a striking member adapted to strike a workpiece;

a drive mechanism connected to the motor, the drive mechanism configured to engage projections on the drive bar to drive the piston in a linear direction;

a first latching member having a first head end configured to lock the drive bar, the first latching member movable between a locked position and a released position; and a second latching member having a second head end configured to lock the drive bar, the second latching member movable between a locked position and a released position, the second head end being offset in a lengthwise direction of the drive bar relative to the first head end, wherein the first head end and the second head end sequentially engage a portion of the drive bar when moving from the locked position to the released position.

13. The pneumatic tool of claim 12, wherein the first and second latching members are configured to move independently of one another.

14. The pneumatic tool of claim 12, wherein the first head end is thinner than the second head end.

15. The pneumatic tool of claim 12, wherein:

the first and second latching members are symmetrically disposed on both sides of a central axis of the drive bar, the drive bar is formed with a plurality of rows of teeth arranged in parallel on a bottom surface of the drive bar, and the first and second latching members are adapted to respectively engage one of the plurality of rows of teeth.

16. A pneumatic tool, comprising:

a motor;

a cylinder filled with high pressure gas;

a drive bar connected to a piston housed in the cylinder and adapted to reciprocate within the cylinder, the piston connected to a striking member adapted to strike a workpiece;

a drive mechanism connected to the motor, the drive mechanism configured to engage projections on the drive bar to drive the piston in a linear direction;

a first latching member having a first head end configured to lock the drive bar; and a second latching member having a second head end configured to lock the drive bar, the first head end being thinner than the second head end.

17. The pneumatic tool of claim 16, wherein the first and second latching members are configured to move independently of one another.

18. The pneumatic tool of claim 16, wherein the second head end is offset in a lengthwise direction of the drive bar relative to the first head end.

19. The pneumatic tool of claim 16, wherein:

the first and second latching members are symmetrically disposed on both sides of a central axis of the drive bar, the drive bar is formed with a plurality of rows of teeth arranged in parallel on a bottom surface of the drive bar, and the first and second latching members are adapted to respectively engage one of the plurality of rows of teeth.

20. The pneumatic tool of claim 1, wherein the drive mechanism reciprocates to drive the piston in the linear direction, and the plurality of latching members are pivotable.

* * * * *